US006352044B1

(12) United States Patent
Peng

(10) Patent No.: US 6,352,044 B1
(45) Date of Patent: Mar. 5, 2002

(54) SEWING NEEDLE STRUCTURE FOR STITCHING A HIDDEN NYLON ZIPPER

(76) Inventor: Mu-Hsun Peng, No. 22, Lane 115, Guanye W. Rd., Pyng-Jenn City, Taoyuan (TW)

( * ) Notice: Subject to any disclaimer, the term of this patent is extended or adjusted under 35 U.S.C. 154(b) by 0 days.

(21) Appl. No.: 09/798,972

(22) Filed: Mar. 6, 2001

(51) Int. Cl.[7] ..... D05B 1/08
(52) U.S. Cl. ..... 112/222; 112/163
(58) Field of Search ..... 112/222, 163, 112/167, 475.16, 225, 226, 165

(56) References Cited

U.S. PATENT DOCUMENTS 1,725,916 A * 8/1929 Hanson ..... 112/226
1,764,865 A * 6/1930 Barber ..... 112/226
3,135,230 A * 6/1964 Warburton ..... 112/475.16
3,348,508 A * 10/1967 Eguchi et al. ..... 112/226
3,490,110 A * 1/1970 Frohlich ..... 112/475.16 X
5,806,450 A * 9/1998 Dudek et al. ..... 112/475.16
6,079,342 A * 6/2000 Tseng ..... 112/226

* cited by examiner

*Primary Examiner*—Ismael Izaguirre
(74) *Attorney, Agent, or Firm*—Rosenberg, Klein & Lee

(57) ABSTRACT

The present invention discloses a sewing needle structure for stitching a hidden nylon zipper, more particularly relates to a sewing needle structure applicable for the hidden nylon zippers of size No. 5 or above, characterized in that the sewing needle structure has at least three needles, which are parallel to each other. Those parallel needles are arranged with a gap having the smallest length within the maximum range and being evenly distributed along the interlocking teeth. The sewing needle structure having at least three needles fixes each seam between the interdigitating teeth, and the distance between the interlocking can be set to a minimum, such that the positioning of each tooth onto the tape by splicing could be more secure and reliable. Furthermore, the turnover folded edges of the two zipper tapes can be directly interlocked and securely coupled, and thereby the nylon zipper attains the hidden effect with high artistic quality.

4 Claims, 5 Drawing Sheets

SEWING NEEDLE STRUCTURE FOR STITCHING A HIDDEN NYLON ZIPPER

BACKGROUND OF THE INVENTION

1. Field of the Invention

The present invention relates to a sewing needle structure for stitching a hidden nylon zipper, more particularly to a sewing needle structure for stitching a hidden nylon zipper of the size No. 5 or above.

2. Description of the Related Art

As implied in the name, a hidden zipper as shown in FIG. 1 is a zipper that interlocks a plurality of interdigitating teeth 3 of a cloth tape 2 by pulling a slider 1 upward, and the interdigiting teeth 3 are totally hidden by the cloth tape 2. Unlike the traditional zipper, the present invention does not expose the interdigitating teeth 3. The emphasis on the hidden zipper lies on the secure positioning of each tooth 3, and when the zipper is in closed position, the turnover edge 21 of the two cloth tapes must be tightly sealed and securely coupled. As the operation of the traditional hidden nylon zipper is performed by means of two needles and two threads. The current specification used for the hidden nylon zipper is mainly 75/11, and the fixing position for installing the slider is § 2 mm from the top end, and the stopper is at § 0.75 mm from the lower end. To arrange the two sewing needles in parallel after installation, the width between the two stoppers can be accommodated completely into the teeth body. The positioning section at the top end of the needle is ground to approximately 0.6 mm, and thereby its central distance is about 0.8 mm (0.4 mm+0.4 mm=0.8 mm) after the teeth are interlocked. The two sewing threads of the stitch coupling the teeth have the maximum width range of about 0.9 mm to 1.0 mm (including the diameter of the sewing thread). Undeniably, width in the range of about 0.9 mm to 1.0 mm to the teeth. For smaller hidden nylon zippers of the size No. 4 or No. 3 having a total tooth width of about 2.6 mm, and the width of the tooth body is about 1.15 mm, it can meet the actual requirement. However, if the user intends to use a No. 5 hidden nylon zipper (having a total tooth width of about 3.7 to 3.8 mm, the crown of about 0.6 mm, the diameter of monofilament tooth of about 0.68 mm, and the tooth body of about 2.52 mm) for the overcoat, purse, bedspread, etc., it is obvious that the operation of the two threads cannot meet the basic requirements for hidden zippers. The width of the two threads is about 0.9 to 1.0 and they are placed in the middle of the tooth body having the width of about 2.52 mm. Obviously, the curved teeth with the total tooth width of about 3.8 mm cannot be surely and securely coupled. Meanwhile, the turnover folded edge of the two cloth tapes in turn results in unseal opening situation. Of course, as shown in FIG. 2, we can reduce the grinding of the single edge of the two needles 10 at the top end of the positioning section 161 so that the central distance a between two needle posts 102 is increased slightly. As shown in FIG. 2, the width b between two sewing stitches 20 can be increased accordingly. However, we all know that the best way to tie the two threads of the stitch is to trisect the total tooth width. The total tooth width of about 3.7 to 3.8 mm is trisected into equal segments, and each segment is about 1.25 mm. Obviously, it is too large for the curved tooth 3 and not able to attain the secure and reliable interlocking effect because the width of each segment for the regular No. 3 hidden nylon zipper is only 0.86 mm. Particularly, the result of the trisection will make the stitches at the inner side of the sewing stitch 20 unable to lean against the crown 31 very closely (as shown in FIG. 3). It also makes the edge 21 of the turnover folded section of the two cloth tapes 2 unable to interlock and has the shortcoming of being in the opened form (as shown in FIG. 4). We can adjust the foregoing sewing stitches 20 at the inner side to a location closer to the edge of the crown 31, but the other sewing stitches 20 will shift as well. Therefore the two sewing stitches 20 will be skewed and not able to position the curved crown 3 with an even sewing force, and the teeth may have a phenomenon of being loosen and fallen apart more easily.

From the above, we learn that the conventional double-stitch double-thread sewing for the hidden nylon zipper cannot apply for the zippers of size No. 5 or above, and such shortcoming needs to be improved.

SUMMARY OF THE INVENTION

The primary objective of the present invention is to provide a sewing needle structure for stitching a hidden nylon zipper, wherein the sewing needle structure has at least three needles, which are parallel to each other. Those parallel needles are arranged with a gap having a minimum length within the maximum range evenly distributed along the interlocking teeth. The sewing needle structure having at least three needles fixes each seam between the interdigitating teeth, and the distance between the interlocking can be set to a minimum, such that the positioning of each tooth onto the tape by splicing could be more secure and reliable. Furthermore, the turnover folded edge of the two zipper tapes can be directly interlocked and definitely sealed, and thereby the nylon zipper attains the hidden effect with high artistic quality.

To make it easier for our examiner to understand the objective of the invention, its structure, innovative features, and its performance, we use a preferred embodiment together with the attached drawings for the detailed description of the invention.

BRIEF DESCRIPTION OF THE DRAWINGS

Other objects, features, and advantages of the invention will become apparent from the following detailed description of the preferred but non-limiting embodiment. The description is made with reference to the accompanying drawings, in which.

DETAILED DESCRIPTION OF THE PREFERRED EMBODIMENTS

Figure 1:
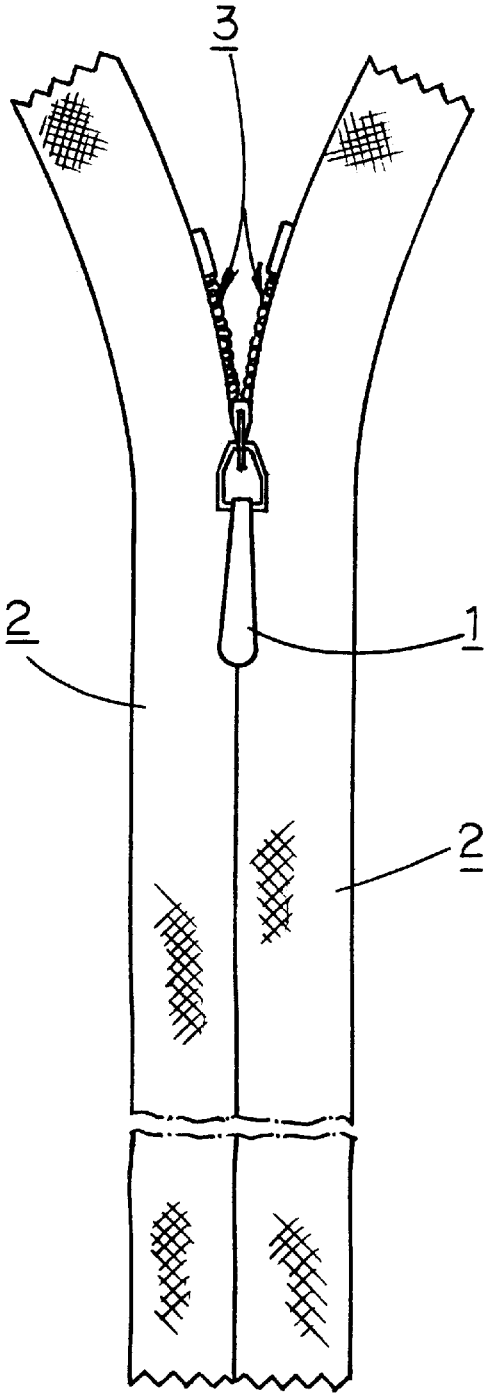
FIG.1 PRIOR ART
FIG. 1 is planar illustrative diagram of a conventional hidden zipper.
Figure 2:
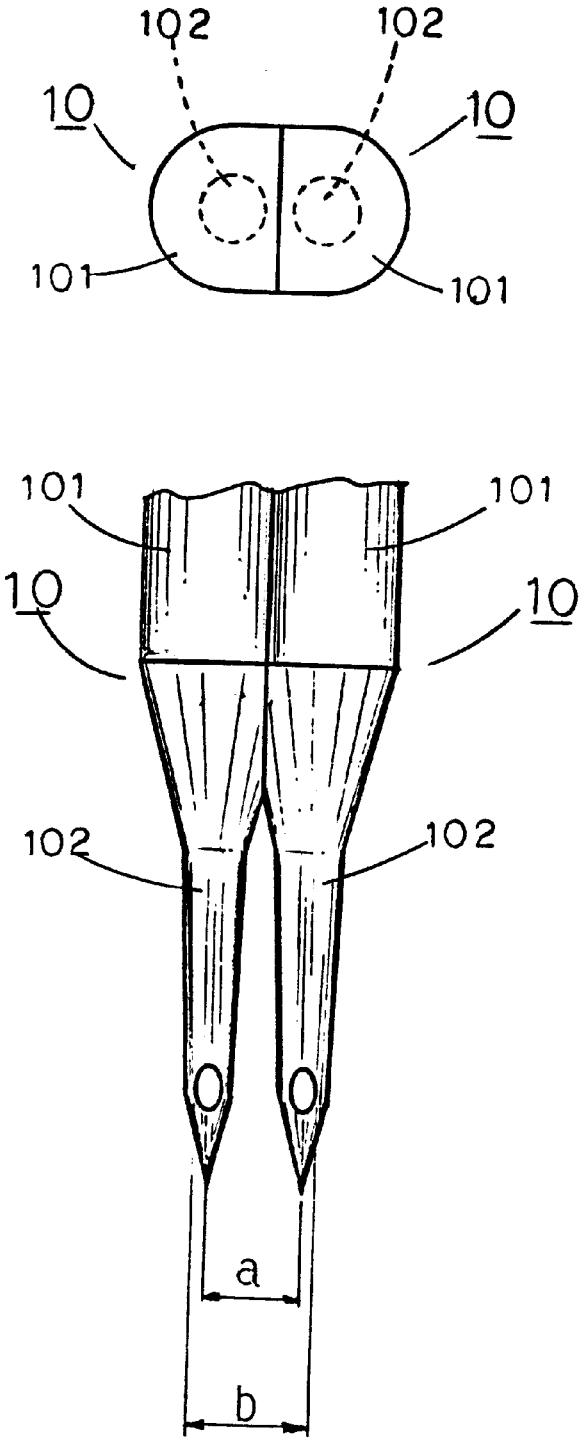
FIG.2 PRIOR ART
FIG. 2 is an illustrative diagram showing the parallel double-needle arrangement of a conventional hidden nylon zipper.
Figure 3:
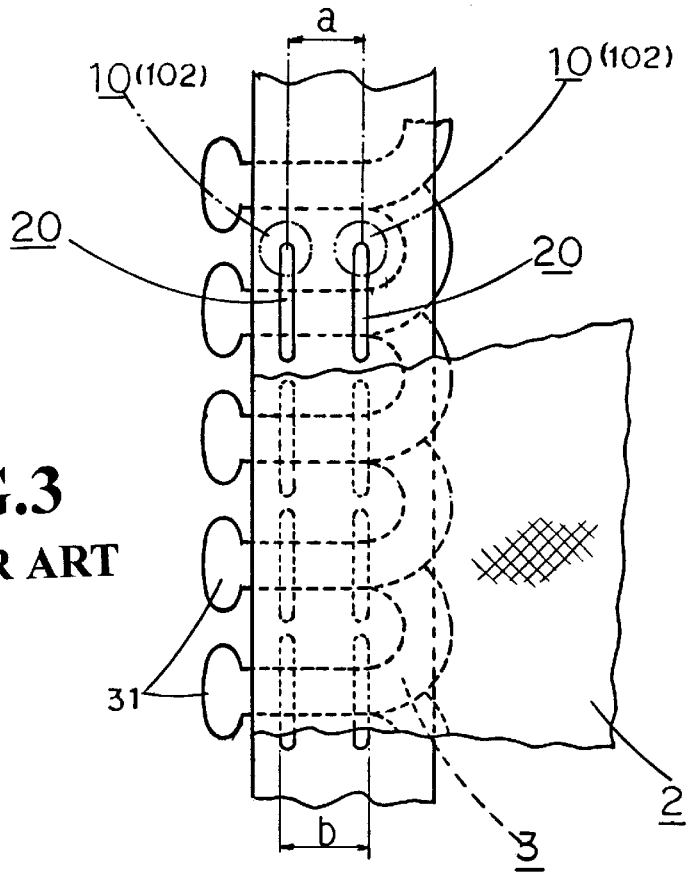
FIG.3 PRIOR ART
FIG. 3 is a top-view diagram of a conventional double-stitch double-thread sewing of a hidden nylon zipper of size No. 5.
Figure 4:
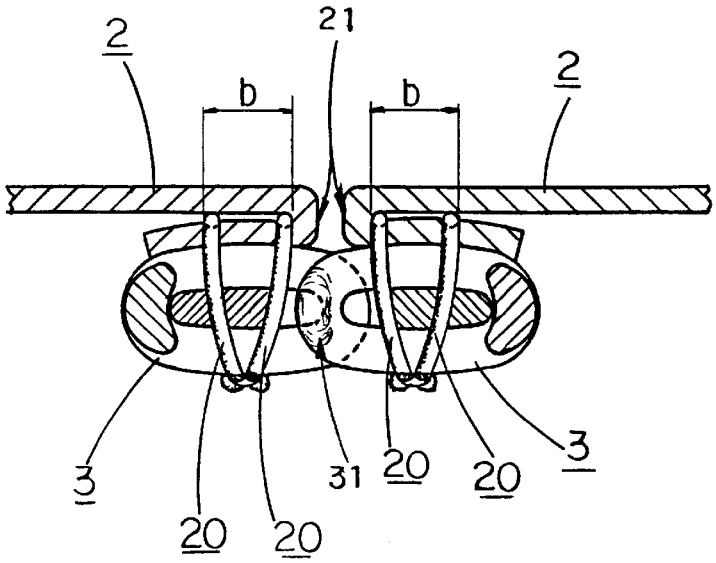
FIG.4 PRIOR ART
FIG. 4 is a front-view diagram of a conventional double-stitch double-thread sewing of a hidden nylon zipper of size No. 5 before the teeth are interlocked.
Figure 5:
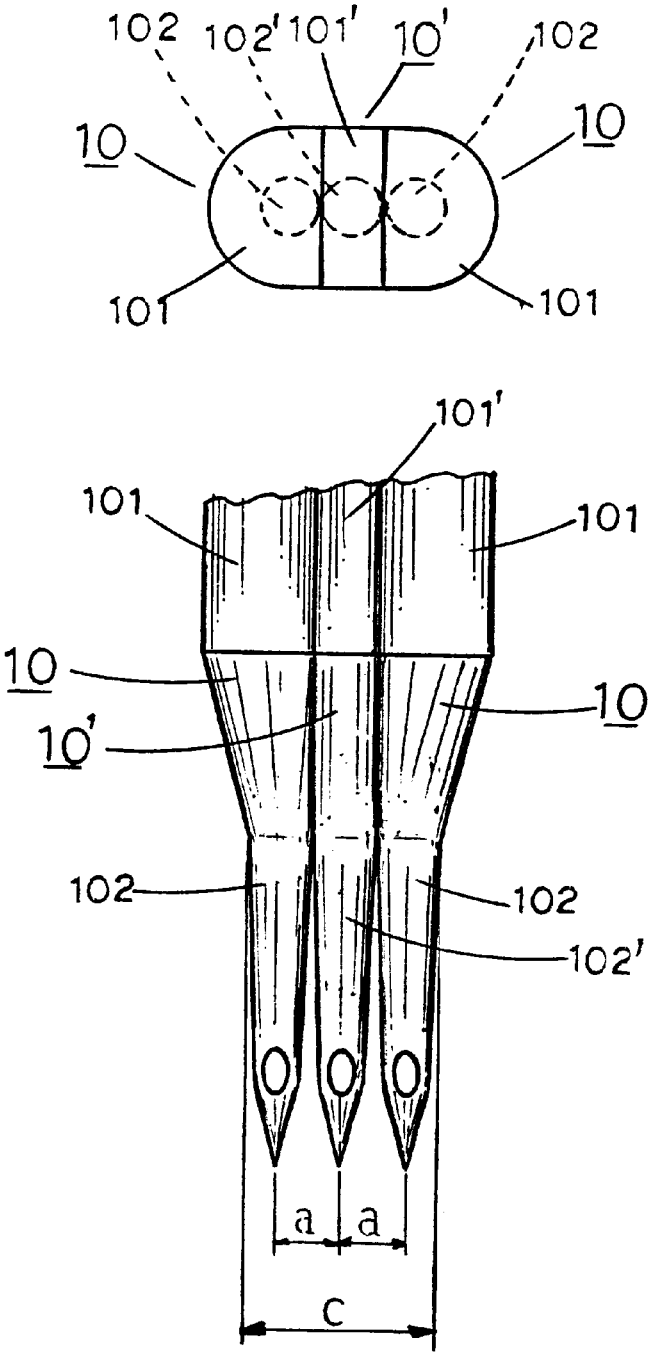
FIG. 5 is a planar illustrative diagram showing the sewing structure of a preferred embodiment according to the present invention.
Figure 6:
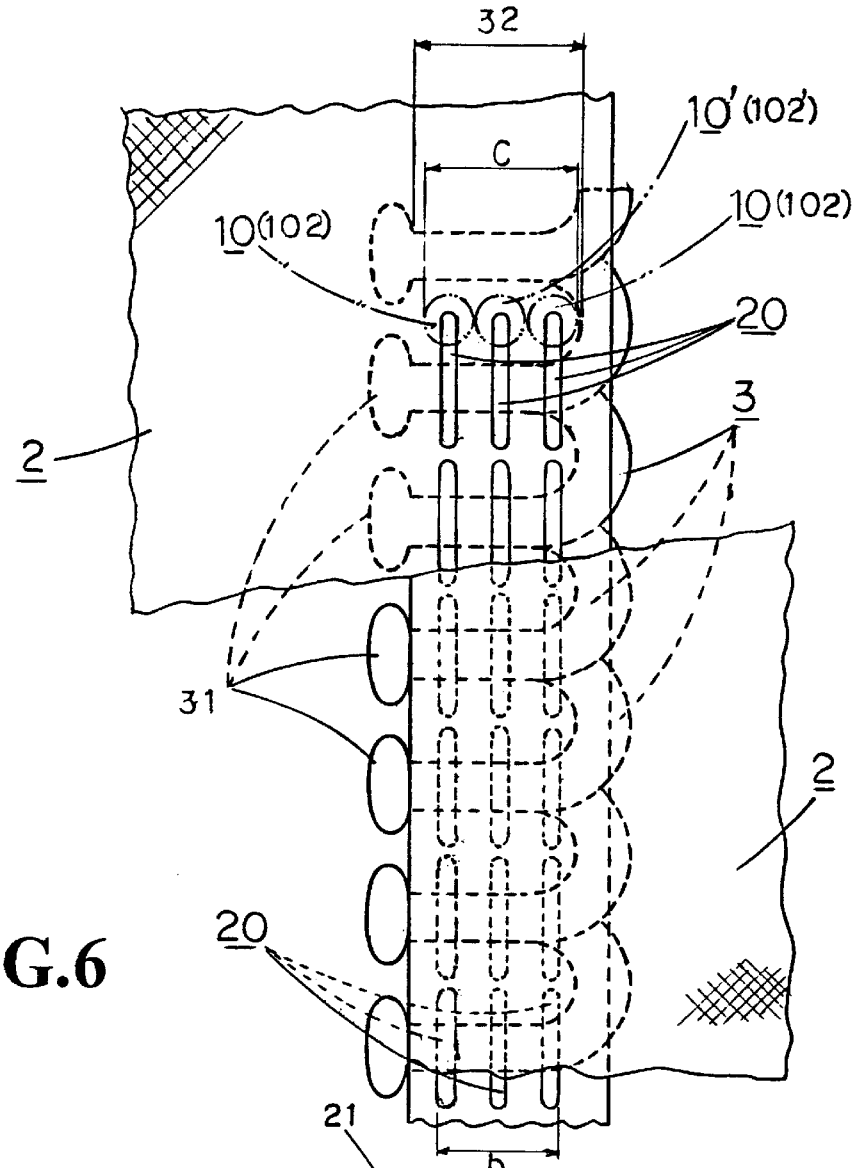
FIG. 6 is a top-view diagram illustrating the tying of the sewing threads on to the hidden nylon zipper of size No. 5 according to a preferred embodiment of the present invention.
Figure 7:
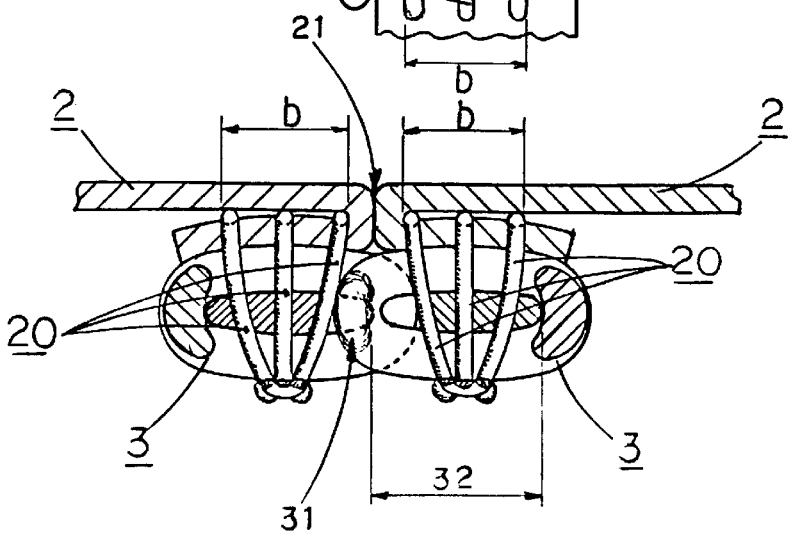
FIG. 7 is an illustrative diagram showing the tying of the sewing threads on to the hidden nylon zipper of size No. 5 according to a preferred embodiment of the present invention before the interdigitated teeth are interlocked.

Please refer to FIG. 5 for a clear indication of the sewing needle structure for stitching a hidden nylon zipper of the present invention. It is mainly used for the relatively larger hidden nylon zipper of size No. 5 or above, and the needle structure 10 (10') is made of at least three parallel assemblies. The number of sewing needles 10 (10') bases on the width of the tooth body of the interdigitated teeth of the monofilament nylon zipper for adjustments or changes, thereby the distance between them can be evenly distributed onto the tooth body of the interdigitated teeth with a minimum length of the upper limit. At the top end positioning section 101 (101') of those needles 10 (10'), the two lateral sides of the edge stitch are ground the same way as the conventional ones, but all other needles (10') located between the two edge needles 10 are aligned parallel and properly equidistant for the grinding. After the needles 10 (10') are aligned in parallel, they are disposed properly with the maximum number in the tooth body of the interdigitated teeth. The equal distance between the needles is minimized. Refer to FIG. 6, and the figure shows the interdigitated teeth of a hidden No. 5 nylon zipper as an embodiment of the present invention. The width of the tooth' body 32 of each interdigitate tooth 3 is about 2.52, and we can have the design with 3 needles 10 (10') and grind the top end positioning section 101 of the two edge needles 10 to about 0.6 mm, and the needles 10' in the middle between the two edge needles 10 are ground to 0.6 mm. Therefore, after the interlock, the largest possible width c of the bottom end of the needle post 102 (102') is about 2.35 mm (2×(0.4+0.375)+0.8=2.35), which can exactly fit in the tooth body 32. When the stitch is sewed to the tooth body of the interdigitated teeth, a small gap between the inner edges of the interdigitated teeth is needed to prevent the risk of having discontinued stitches. The central distance a between them is minimized to about 0.6 mm. Since the top end positioning section of the needle can be ground, but the bottom end of the positioning section of the needle absolutely cannot be grounded or reduced, otherwise the needle will be broken very easily during stitching. The maximum diameter of the stitching needle is only 0.75 mm (i.e. the radius is about 0.375 mm). Naturally, when the top end positioning section is grounded away 0.6 mm, it leaves 0.8 mm (0.4+0.4=0.8) which is the minimum, thereby the tooth body 32 of the interdigitated teeth is guided simultaneously into the sewing stitches by the largest number of three sewing needles 10 (10'), i.e. the total width b of the tooth body 32 at the stitches of the sewing stitch 20 is maximized, and the distance a between each needle is minimized. Therefore the three sewing stitches are able to surely and securely tie each tooth onto the fixing position on the cloth tape 2 to improve the foregoing shortcomings of the double-needle double-thread sewing structure for being loosen and fallen apart. Since after the sewing needles 10(10') are interlocked, the distance c at the bottom end between the needles 102 is very close to the width of the tooth body of the interdigitated teeth 3, and the sewing stitches at the inner side of the sewing stitches 20 must also be very close to the crown 31 of the interdigitated teeth 3. When the two cloth tapes 2 are turned over and folded, and the teeth 3 are interdigitated for closing the zipper, the two folded edges 21 are surely and securely coupled to attain the artistic effect, and the expected invisible effect for the zipper.

Since the hidden zipper of the present invention and the traditional zipper mainly differ in whether or not the cloth tape can implement the folding movement after the sewing stitches of the interdigitated teeth are fixed to the cloth tape. The way of implementing the stitches, sewing needles, and the interdigitated teeth are the same. After the interdigitated teeth of a hidden zipper are fixed to the cloth tape, such cloth tape still needs to perform the turn-over folding so that when pulling the slider along the stitches to interdigitate the teeth between two cloth tapes, the interdigitated teeth can be hidden completely by the cloth tape without having exposure of any part of it. Further, after the interdigitated teeth of a traditional zipper, which is not a hidden zipper, are fixed to the cloth tape, such cloth tape needs not to perform the turnover folding so that when pulling the slider along the stitches to interdigitate the teeth between two cloth tapes, the interdigitated teeth will expose. As we can see that the operation of a hidden zipper and that of a traditional zipper are exactly the same. In the completely same way of operation, the present invention is also applicable for the operation of the tradition zipper of size No. 5 or above, Therefore in summation of the above description, the present invention herein improves the conventional structure. It further complies with the patent application requirements and is submitted to the Patent and Trademark Office for review and granting of the commensurate patent rights.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A sewing needle apparatus for stitching to a tape material in hidden manner a nylon zipper having a plurality of teeth each defining a stitching space of a standard predetermined tooth body width, said sewing needle apparatus comprising at least three needle portions disposed in substantially parallel and equidistantly spaced manner, said needle portions being configured to concurrently insert into the stitching space of one zipper tooth.

2. The sewing needle apparatus as recited in claim 1 wherein said needle portions are configured to concurrently insert into the stitching space of a zipper tooth defining a standard tooth body width of approximately 2.52 mm.

3. A sewing needle apparatus for stitching to a tape material in hidden manner a nylon zipper having a plurality of teeth each defining a stitching space of a standard tooth body width greater than approximately 1.55 mm, said sewing needle apparatus comprising a pair of outer needle portions and at least one intermediate needle portion disposed therebetween, said intermediate needle portion being substantially parallel to said outer needle portions, said outer and intermediate needle portions being disposed in equidistantly spaced manner, said outer and intermediate needle portions being configured to concurrently insert into the stitching space of one zipper tooth.

4. The sewing needle apparatus as recited in claim 3 wherein said outer and intermediate needle portions are configured to concurrently insert into the stitching space of a zipper tooth defining a standard tooth body width of approximately 2.52 mm.

* * * * *